US006992642B2

(12) United States Patent
Goldman et al.

(10) Patent No.: US 6,992,642 B2
(45) Date of Patent: Jan. 31, 2006

(54) TELESCOPIC RETRACTABLE ANTENNA WITH IMPROVED CONTACT SYSTEM

(75) Inventors: Ruvim Goldman, Nazeret Illit (IL); Michael Elliott, Poriyya Illit (IL)

(73) Assignee: Galtronics Ltd., Tiberias (IL)

( * ) Notice: Subject to any disclaimer, the term of this patent is extended or adjusted under 35 U.S.C. 154(b) by 0 days.

(21) Appl. No.: 10/798,220

(22) Filed: Mar. 11, 2004

(65) Prior Publication Data

US 2004/0217917 A1 Nov. 4, 2004

Related U.S. Application Data

(60) Provisional application No. 60/454,393, filed on Mar. 13, 2003.

(51) Int. Cl.
*H01Q 1/10* (2006.01)

(52) U.S. Cl. ..... 343/901; 343/702

(58) Field of Classification Search ..... 343/901, 343/702, 903, 900, 752, 906
See application file for complete search history.

(56) References Cited

U.S. PATENT DOCUMENTS

| | | | | |
|---|---|---|---|---|
| 3,182,329 A | | 5/1965 | Biesecker | 343/702 |
| 3,560,981 A | | 2/1971 | Pestka | 343/702 |
| 5,245,350 A | | 9/1993 | Sroka | 343/702 |
| 5,363,727 A | * | 11/1994 | Barth et al. | 81/177.2 |
| 5,546,094 A | | 8/1996 | Egashira | 343/702 |
| 5,748,150 A | | 5/1998 | Rudisill | 343/702 |
| 5,757,325 A | | 5/1998 | Saldell | 343/702 |
| 5,793,331 A | | 8/1998 | Anzai et al. | 343/702 |
| 5,835,070 A | | 11/1998 | Scaraglino | 343/877 |
| 5,856,806 A | | 1/1999 | Koleda | 343/702 |
| 6,008,765 A | * | 12/1999 | Davidson et al. | 343/702 |
| 6,034,630 A | | 3/2000 | Komatsu et al. | 341/159 |
| 6,034,639 A | * | 3/2000 | Rawlins et al. | 343/702 |
| 6,037,906 A | | 3/2000 | Engblom | 343/702 |
| 6,236,369 B1 | | 5/2001 | Krishtul et al. | 343/702 |
| 6,383,898 B1 | * | 5/2002 | Kishimoto | 438/482 |
| 6,573,868 B2 | * | 6/2003 | Johnson et al. | 343/702 |

* cited by examiner

*Primary Examiner*—Thuy V. Tran
*Assistant Examiner*—Huedung X. Cao
(74) *Attorney, Agent, or Firm*—Ladas and Parry LLP

(57) ABSTRACT

A retractable antenna including an outer elongate telescopic element extending along an elongate axis, an inner elongate telescopic element which is slidable along the elongate axis with respect to the outer elongate telescopic element from a fully retracted position to a fully extended position; and an extended position retaining spring fixedly positioned with respect to the outer elongate telescopic element for frictional extended position retaining engagement with the inner elongate telescopic element when the inner elongate telescopic element is in the fully extended position but not when the inner elongate telescopic element is generally in a retracted position.

10 Claims, 7 Drawing Sheets

TELESCOPIC RETRACTABLE ANTENNA WITH IMPROVED CONTACT SYSTEM

This application claims the benefit of U.S. Provisional Application No.: 60/454,393 filed Mar. 13, 2003 and incorporates the same by reference.

FIELD OF THE INVENTION

The present invention relates to antennas generally and more generally to retractable antennas.

BACKGROUND OF THE INVENTION

The present state of the art is exemplified by U.S. Pat. No. 6,034,639, which is characterized in that a spring element fixed to an interior telescopic element is in continuous contact with the interior of a telescoping element.

SUMMARY OF THE INVENTION

The present invention seeks to provide an improved retractable antenna which is characterized by a relatively long operating lifetime and high reliability.

There is thus provided in accordance with a preferred embodiment of the present invention a retractable antenna including an outer elongate telescopic element extending along an elongate axis, an inner elongate telescopic element which is slidable along the elongate axis with respect to the outer elongate telescopic element from a fully retracted position to a fully extended position; and an extended position retaining spring fixedly positioned with respect to the outer elongate telescopic element for frictional extended position retaining engagement with the inner elongate telescopic element when the inner elongate telescopic element is in the fully extended position but not when the inner elongate telescopic element is generally in a retracted position.

In accordance with a preferred embodiment of the present invention the outer elongate telescopic element is formed with a throughgoing bore Which extends along the elongate axis from a base end to an opposite end. Additionally, the throughgoing bore is formed to have a first inner diameter D1 at a first elongate portion thereof which extends along a majority of its length extending from the base end and a second inner diameter D2 which is greater than the first inner diameter D1, at a second elongate portion thereof near but spaced from the opposite end.

In accordance with another preferred embodiment of the present invention the second elongate portion defines a recess for receiving the extended position retaining spring. Alternatively or additionally, the throughgoing bore also includes a third elongate portion adjacent the opposite end having a third inner diameter D3, which is greater than the second inner diameter D2, the third elongate portion defining a recess for receiving a retaining ring for retaining the spring in position along the elongate axis. In accordance with yet another preferred embodiment of the present invention the third elongate portion is necked inwardly adjacent the opposite end.

In accordance with another preferred embodiment of the present invention the extended position retaining spring has a generally cylindrical configuration defining an elongate gap extending along the length thereof, a pair of incomplete end rings and generally elongate portions extending between the rings, the elongate portions being separated from each other by elongate slots and being slightly bent inwardly so as to together define a waist at a frictional engagement location therealong, at which inner facing surfaces of the generally elongate portions define, at rest, an imaginary circle having an inner diameter D4, less than the first inner diameter D1.

In accordance with yet another preferred embodiment of the present invention the inner elongate telescopic element has a back end and a forward end and includes a back cylindrical portion, near the back end, having an outer diameter D5, which is at least equal to the inner diameter D4 but less than the first inner diameter D1, so as to be frictionally engaged by the extended position retaining spring and a main cylindrical portion, forward of the back cylindrical portion, having an outer diameter D6, which is smaller than the inner diameter D4, so as not to be significantly frictionally engaged by the extended position retaining spring. Additionally or alternatively, in a generally non-extended orientation the main cylindrical portion lies inside of the extended position retaining spring, whereby due to the outer diameter D6 of the main cylindrical portion being less than the inner diameter D4 of the extended position retaining spring at the frictional engagement location, substantial frictional engagement of and consequent wear on the main cylindrical portion and the spring are avoided and wherein in fully extended orientation the back cylindrical portion lies inside of the spring, whereby due to the outer diameter D5 of the back cylindrical portion being at least equal to the inner diameter D4 of the extended position retaining spring at the frictional engagement location substantial frictional engagement of the back cylindrical portion and the extended position retaining spring is provided for desired retention of the antenna in an extended operative orientation.

In accordance with still another preferred embodiment of the present invention the extended position retaining spring is a unitary element.

In accordance with another preferred embodiment of the present invention the inner elongate telescopic element has a back end and a forward end and includes a back cylindrical portion, near the back end, having an outer diameter D5, which is at least equal to the inner diameter D4 so as to be frictionally engaged by the extended position retaining spring and a main cylindrical portion, forward of the back cylindrical portion, having an outer diameter D6, which is smaller than the inner diameter D4, so as not to be significantly frictionally engaged by the extended position retaining spring.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
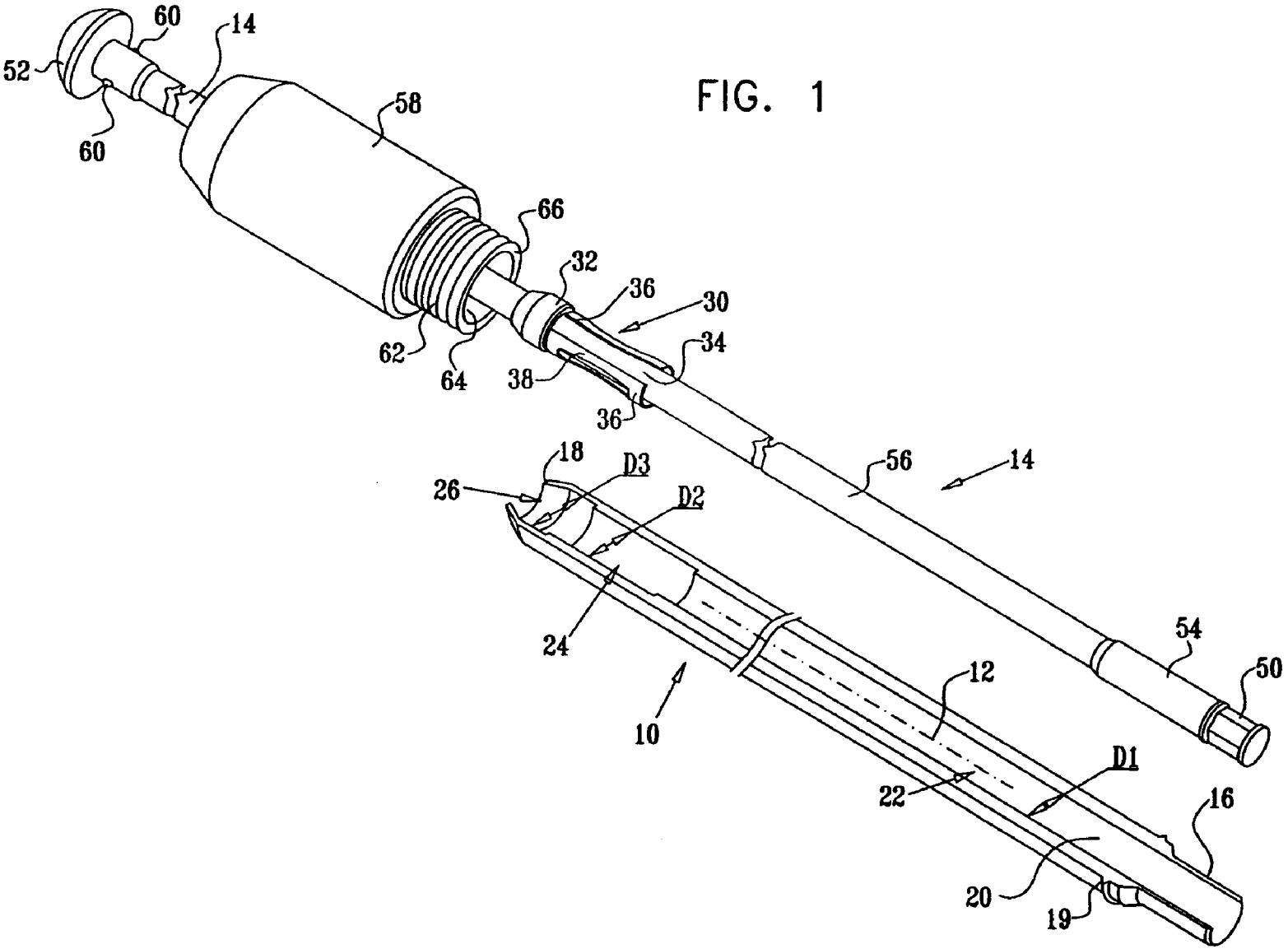
FIG. 1 is a simplified exploded view partially cut-away pictorial illustration of a retractable antenna constructed and operative in accordance with a preferred embodiment of the present invention.

Reference is now made to FIG. 1, which is a simplified exploded view partially cut-away pictorial illustration of a retractable antenna constructed and operative in accordance with a preferred embodiment of the present invention. As seen in FIG. 1, the retractable antenna preferably comprises an outer elongate telescopic element 10, defining an elongate axis 12, and an inner elongate telescopic element 14 which is slidable along axis 12, with respect to outer elongate telescopic element 10, from a fully retracted position, shown in FIGS. 2A and 3A, to a partially extended position, shown in FIGS. 2B and 3B, to a fully extended position, shown in FIGS. 2C and 3C.

Outer elongate telescopic element 10 preferably is formed with a base end 16 and an open opposite end 18. An outwardly extending retaining protrusion 19 is formed on element 10 adjacent but spaced from end 16. A throughgoing bore 20 extends along axis 12 from base end 16 to opposite end 18 and typically has a first inner diameter D1 at a first elongate portion 22 which extends along a majority of its length extending from base end 16, a second inner diameter D2, which is preferably greater than D1, at a second elongate portion 24 near but spaced from opposite end 18 and a third inner diameter D3, which is preferably greater than D2, at a third elongate portion 26 adjacent base end 18. Alternatively, third elongate portion 26 may be obviated. Second elongate portion 24 preferably defines a recess for receiving an extended position retaining spring 30 and third elongate portion 26 preferably defines a recess for receiving a retaining ring 32. Third elongate portion 26 is preferably necked inwardly adjacent opposite end 18.

Figure 2A:
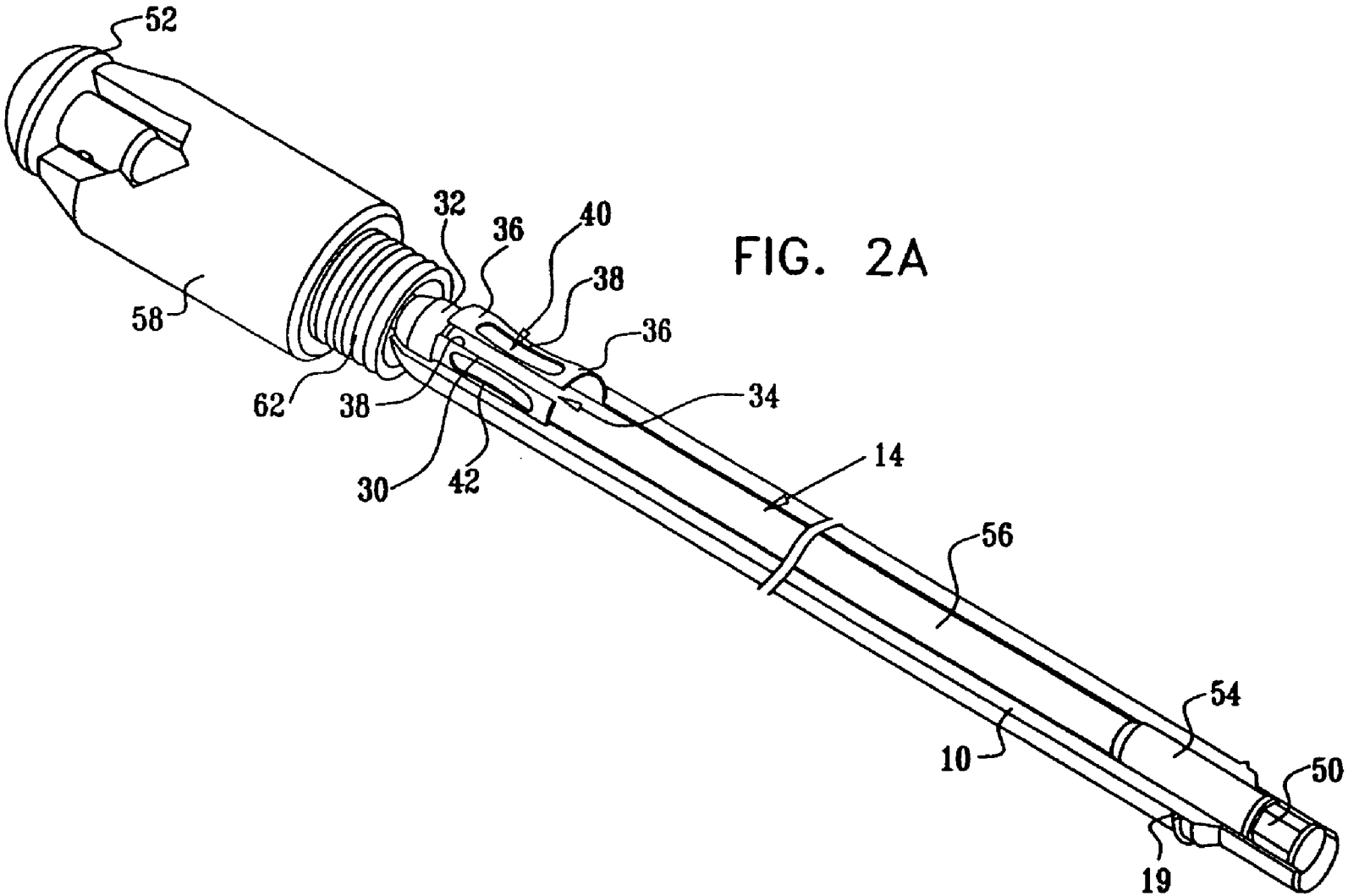
FIGS. 2A, 2B and 2C are simplified partially cut-away pictorial illustrations of the retractable antenna of FIG. 1 in respective retracted, partially extended and fully extended operative orientations.

Extended position retaining spring 30 preferably is a unitary element manufactured of spring steel having a generally cylindrical configuration defining an elongate gap 34 extending along the length thereof, a pair of incomplete end rings 36 and generally elongate portions 38 extending between rings 36 and being separated from each other by elongate slots 40 (FIG. 2A). Generally elongate portions 38 are each slightly bent inwardly so as to together define a waist at a frictional engagement location 42 (FIG. 2A) therealong, at which inner facing surfaces of generally elongate portions 38 define, at rest, an imaginary circle having a diameter D4 (FIG. 3A), which is less than D1.

Retaining ring 32 is preferably configured to be retained in third elongate portion 26 and to prevent spring 30 from moving towards opposite end 18.

Inner elongate telescopic element 14 is preferably formed of metal or plastic coated metal and includes a crimped back end 50 and a forward end 52. A back cylindrical portion 54 of element 14, near back end 50, preferably has an outer diameter D5 (FIG. 3B), which is slightly larger than diameter D4, but less than diameter D1, so as to frictionally engage spring 30. A main cylindrical portion 56 of element 14, forward of portion 54, preferably has an outer diameter D6 (FIG. 3A), which is smaller than diameter D4, so as not to be significantly frictionally engaged by retaining spring 30.

An antenna assembly retaining collar element 58 engages a suitably threaded socket in a communications device such as a cellular telephone (not shown) and retains the retractable antenna in operative engagement with the communications device. Preferably protrusions 60, formed on inner elongate telescopic element 14 near forward end 52 thereof, frictionally engage the walls of an interior bore formed in collar element 58 for removably retaining the inner elongate telescopic element in a retracted operative orientation. Collar element 58 includes an outer threaded base portion 62 having formed therein a bore 64 whose inner diameter can slidably accomodate element 10, other than protrusion 19. Accordingly engagement of a bottom edge 66 of base portion 62 with protrusion 19 limits the telescopic extension of element 10 relative to collar element 58.

Figure 2B:
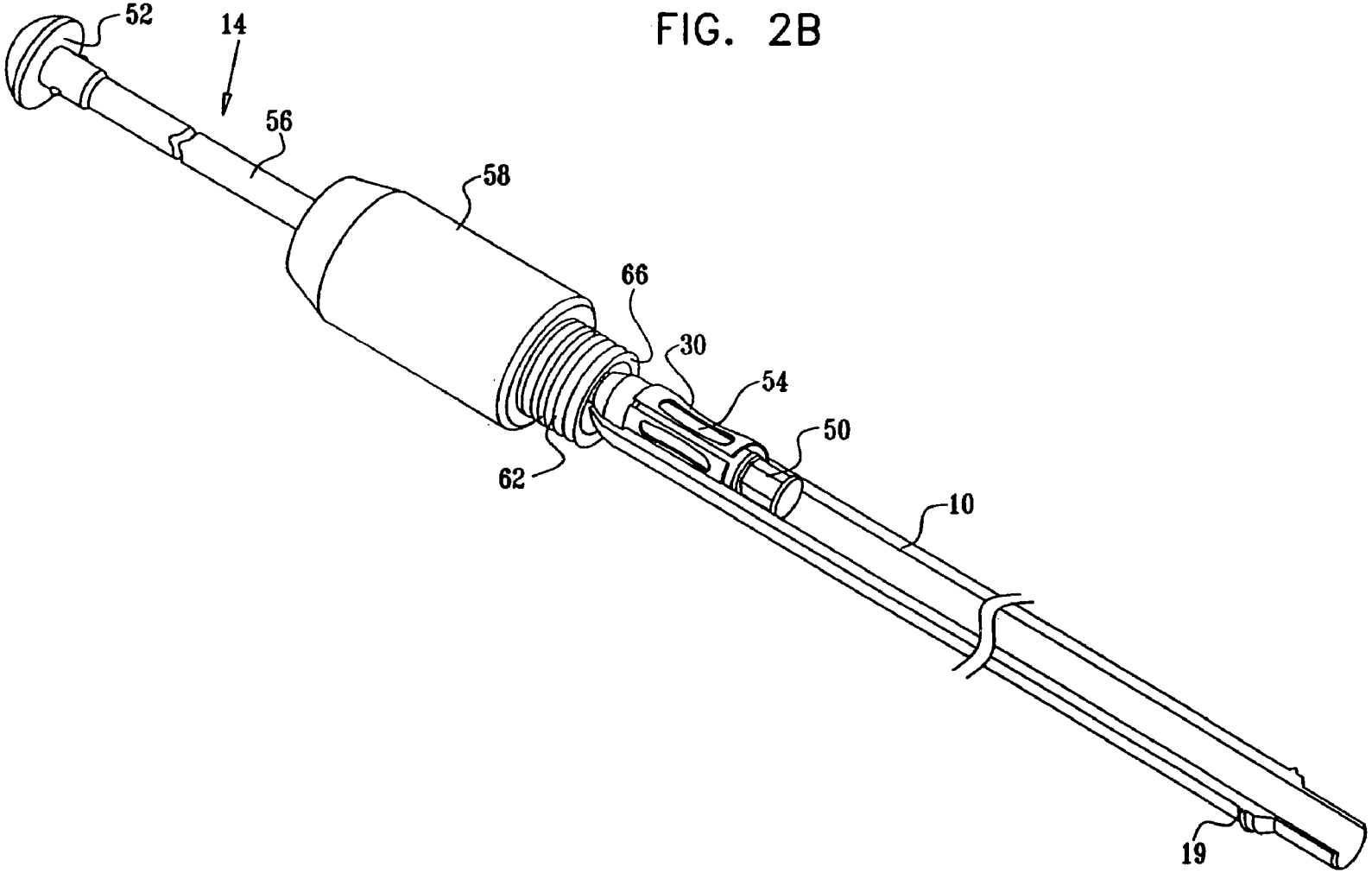
Figure 2C:
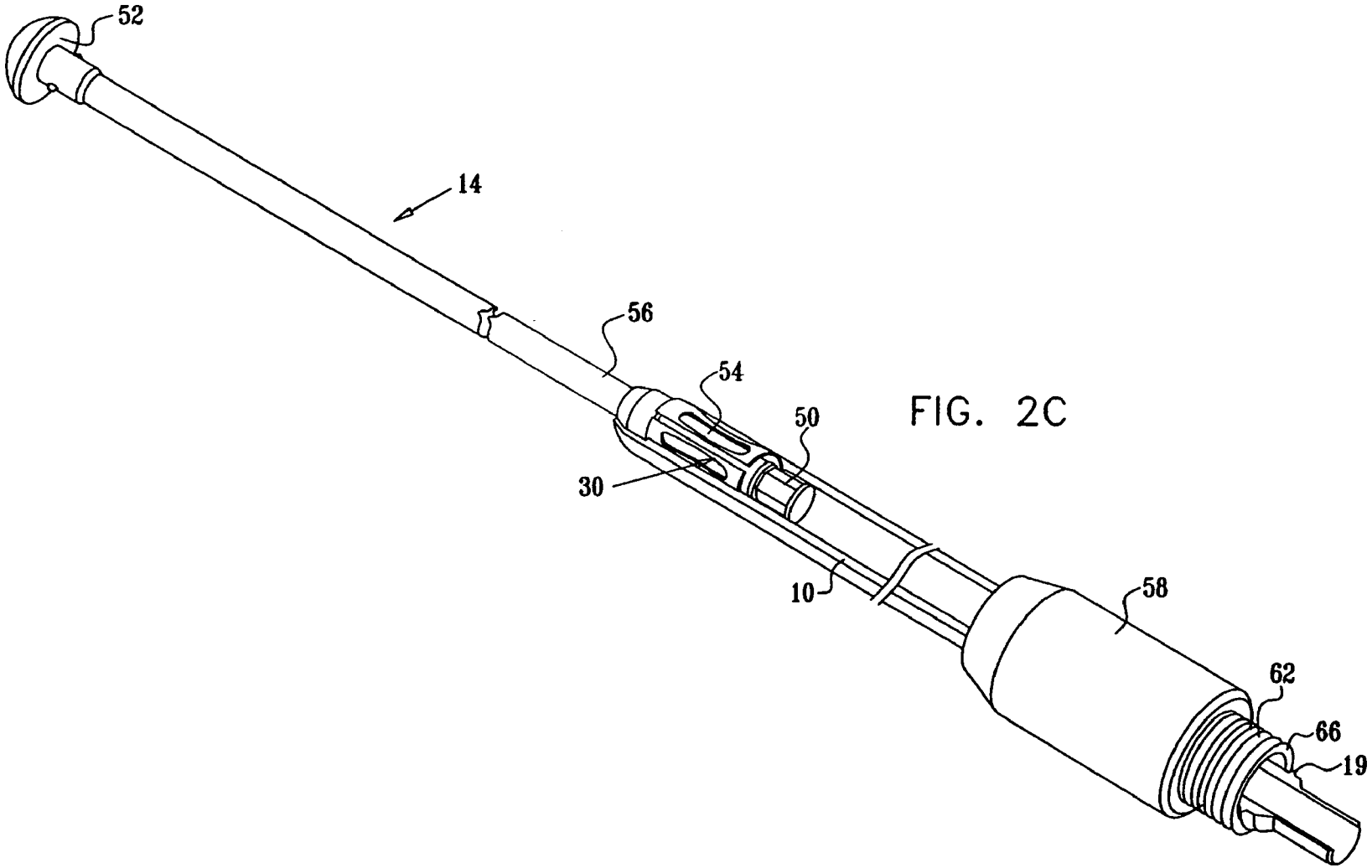
Figures 3A, 4A:
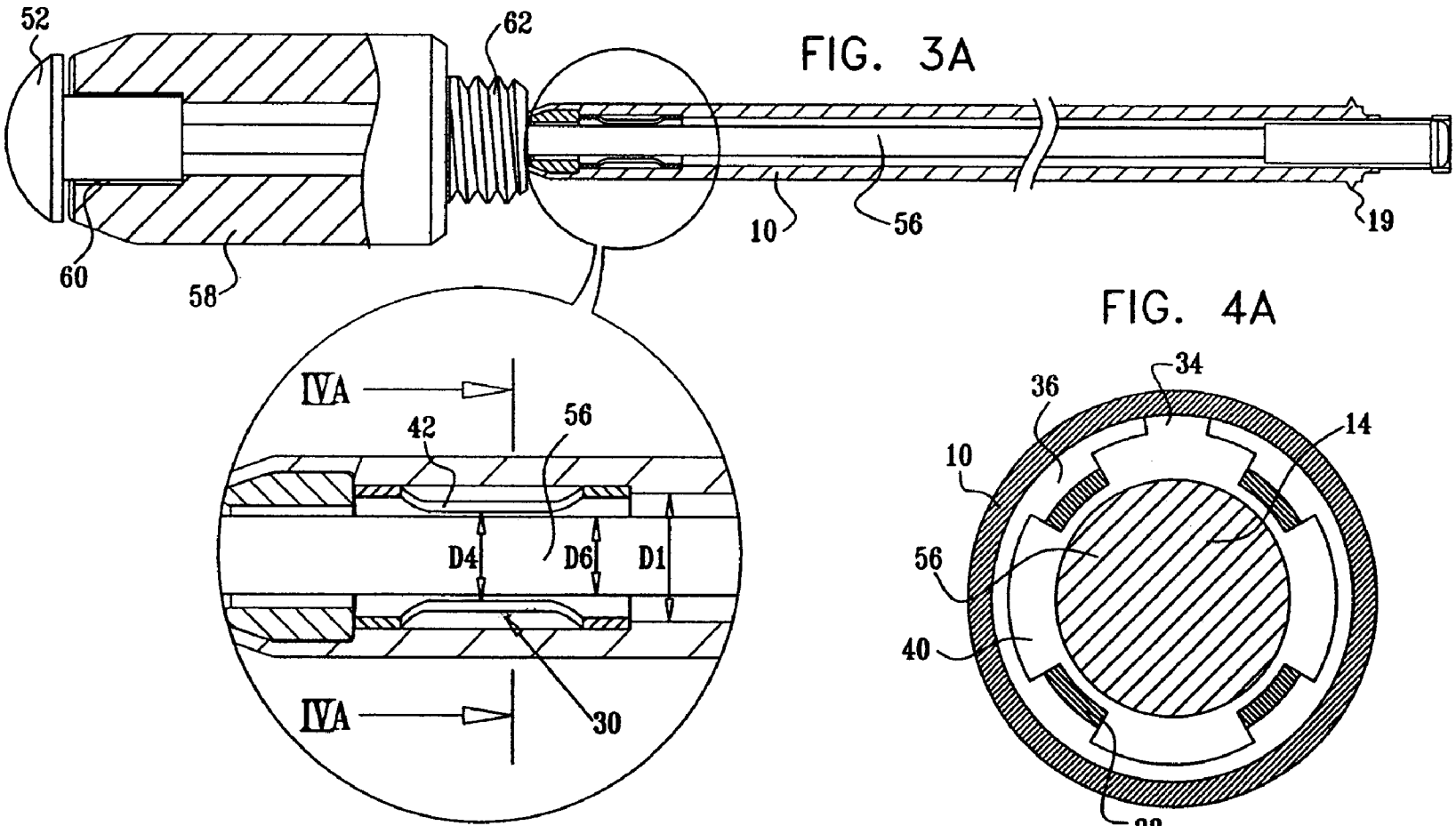
FIGS. 3A, 3B and 3C are simplified sectional illustrations of part of the retractable antenna of FIG. 1 in respective retracted, partially extended and fully extended operative orientations, corresponding to those illustrated in FIGS. 2A, 2B and 2C respectively.
FIGS. 4A, 4B and 4C are simplified sectional illustrations taken along respective lines IVA—IVA, IVB—IVB and IVC—IVC in FIGS. 3A, 3B and 3C.
Figures 3B, 4B:
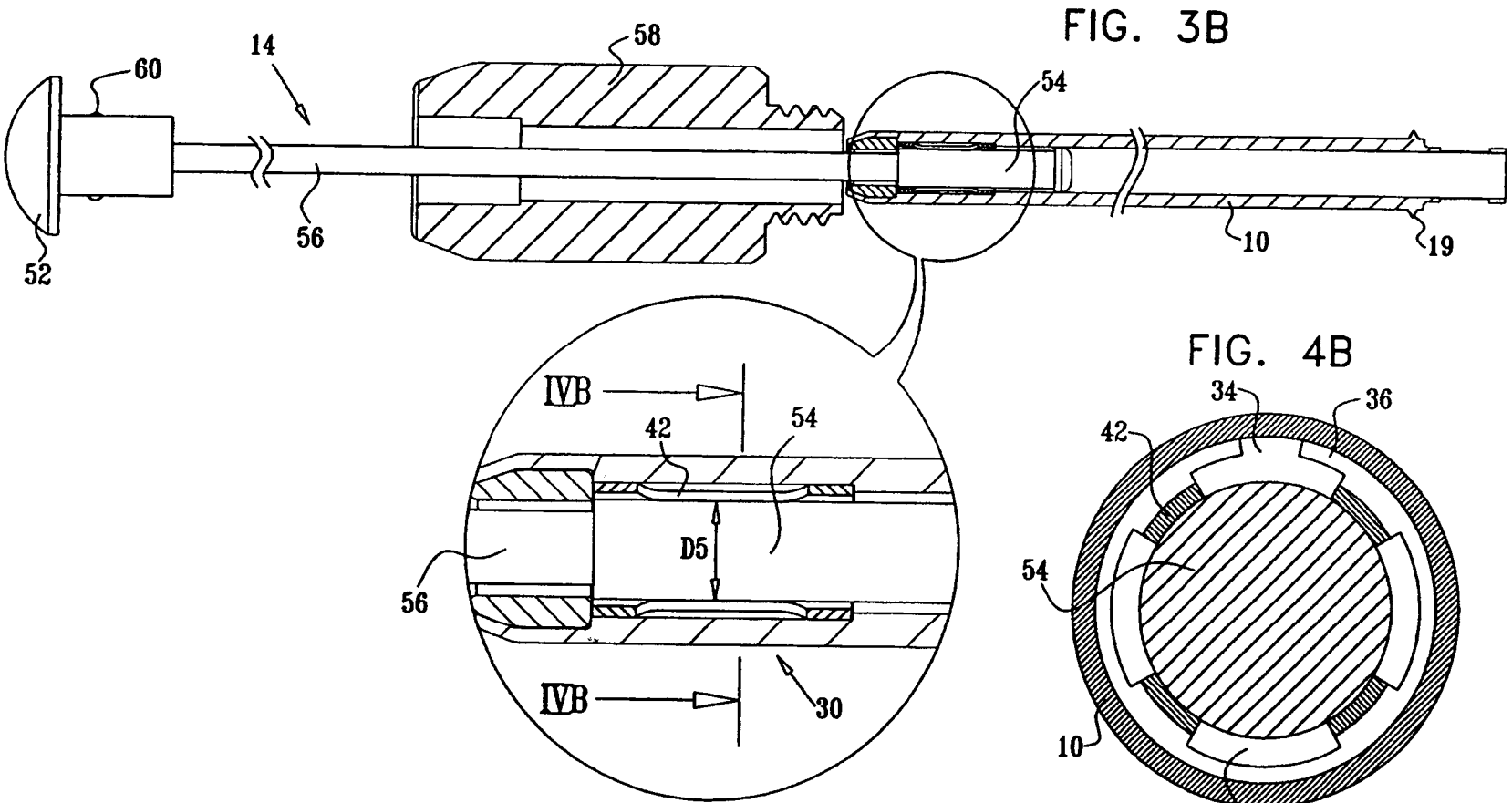
Figure 3C:
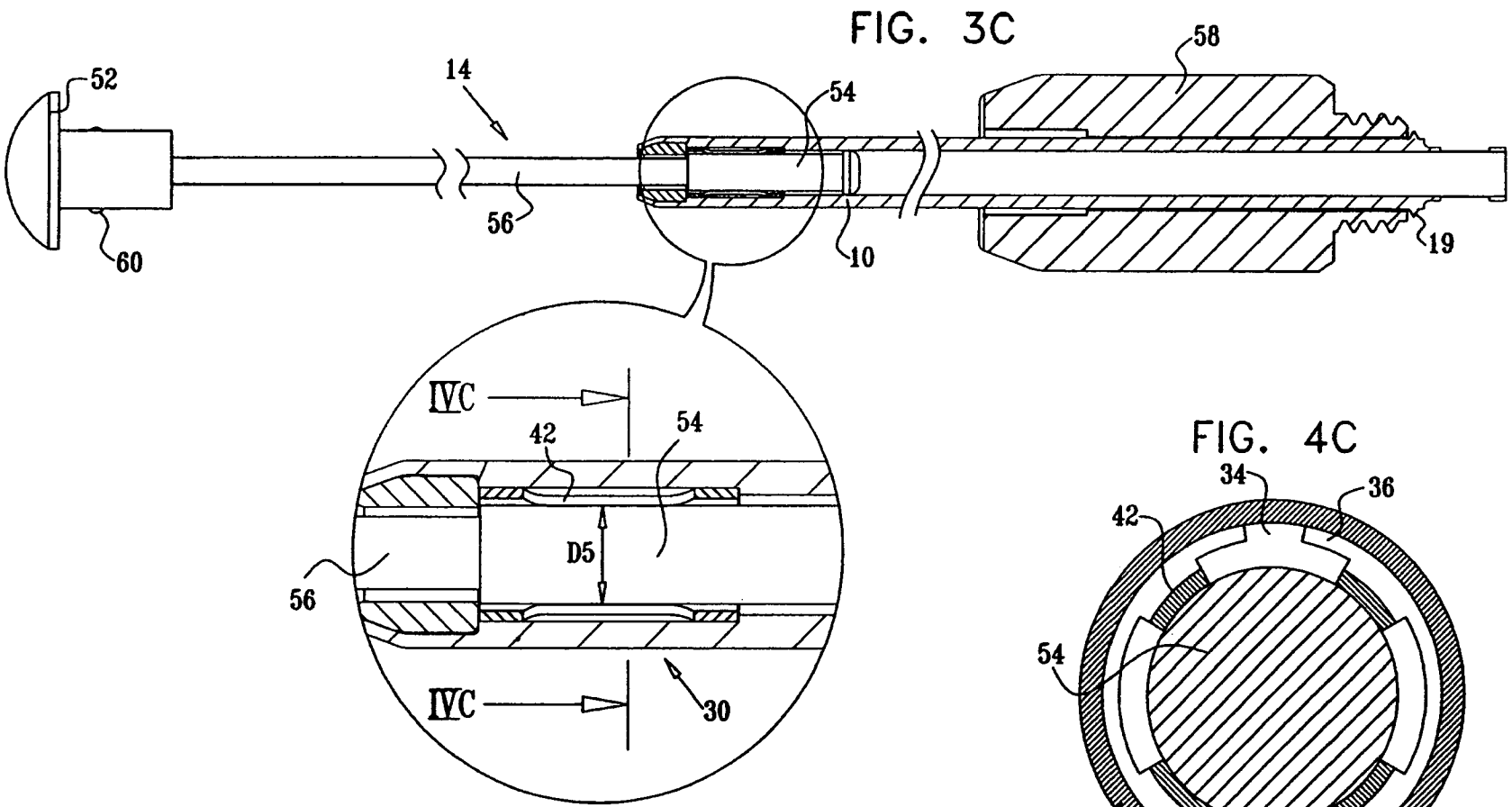
Figure 4C:
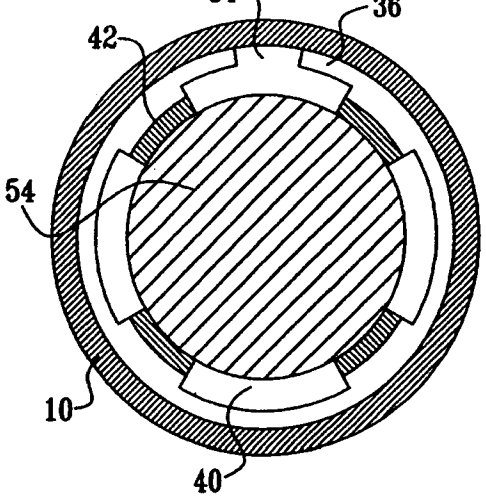

Reference is now made to FIGS. 2A, 2B and 2C, which are simplified partially cut-away pictorial illustrations of the retractable antenna of FIG. 1 in respective retracted, partially extended and fully extended operative orientations, FIGS. 3A, 3B and 3C, which are simplified sectional illustrations of part of the retractable antenna of FIG. 1 in respective retracted, partially extended and fully extended operative orientations, corresponding to those illustrated in FIGS. 2A, 2B and 2C respectively, and FIGS. 4A, 4B and 4C, which are simplified sectional illustrations taken along respective lines IVA—IVA, IVB—IVB and IVC—IVC in FIGS. 3A, 3B and 3C.

Referring specifically to FIGS. 2A, 3A and 4A, which illustrate a retracted orientation of the retractable antenna of FIG. 1, it is seen that in this orientation, main cylindrical portion 56 of element 14 lies inside of spring 30. Since the outer diameter of cylindrical portion 56 of element 14, D6, is less than the inner diameter, D4, of the narrowest portion of spring 30, it is appreciated that substantial frictional engagement of and consequent wear on cylindrical portion 56 and spring 30 are avoided. This, prepferably, is the case for generally all non-fully extended operative orientations of element 14 of the retractable antenna, since cylindrical portion 56 having outer diameter D6 extends over most of the length of element 14.

Referring specifically to FIGS. 2B, 3B and 4B, which illustrate a partially extended orientation of the retractable antenna of FIG. 1, it is seen that in this orientation, back cylindrical portion 54 of element 14 lies inside of spring 30. Since the outer diameter of cylindrical portion 54 of element 14, D5, is slightly greater than the inner diameter D4 of the narrowest portion of spring 30, it is appreciated that substantial frictional engagement of cylindrical portion 54 and spring 30 is provided for desired retention of the antenna in an extended operative orientation. This is the case generally for fully extended operative orientation of element 14 of the retractable antenna.

Referring specifically to FIGS. 2C, 3C and 4C, which illustrate a fully extended orientation of the retractable antenna of FIG. 1, it is seen that in this orientation, back cylindrical portion 54 of element 14 lies inside of spring 30. Since the outer diameter of cylindrical portion 54 of element 14, D5, is slightly greater than the inner diameter D4 of the narrowest portion of spring 30, it is appreciated that substantial frictional engagement of cylindrical portion 54 and spring 30 is provided for desired retention of the antenna in an extended operative orientation. This is the case generally only for a fully or nearly fully extended operative orientation of the retractable antenna, since cylindrical portion 56 having outer diameter D6 smaller than diameter D4 extends over most of the length of element 14.

It will be appreciated by persons skilled in the art that the present invention is not limited to what has been particularly shown and described hereinabove. Rather the scope of the invention includes combinations and subcombinations of the various features described hereinabove as well as modifications and variations thereof which would occur to a person of ordinary skill in the art upon reading the foregoing description and which are not in the prior art.

What is claimed is:

1. A retractable antenna comprising:

an outer elongate telescopic element extending along an elongate axis;

an inner elongate telescopic element which is slidable along said elongate axis with respect to said outer elongate telescopic element from a fully retracted position to a fully extended position; and an extended position retaining spring fixedly positioned with respect to said outer elongate telescopic element for frictional extended position retaining engagement with said inner elongate telescopic element when said inner elongate telescopic element is in said fully extended position but not when said inner elongate telescopic element is generally in a retracted position, said outer elongate telescopic element being formed with a throughgoing bore which extends along said elongate axis from a base end to an opposite end, said throughgoing bore being formed to have a first inner diameter D1 at a first elongate portion thereof which extends along a majority of its length extending from said base end and a second inner diameter D2 which is greater than said first inner diameter D1, at a second elongate portion thereof near but spaced from said opposite end.

2. A retractable antenna according to claim 1 and wherein said second elongate portion defines a recess for receiving said extended position retaining spring.

3. A retractable antenna according to claim 2 and wherein said extended position retaining spring has a generally cylindrical configuration defining an elongate gap extending along the length thereof, a pair of incomplete end rings and generally elongate portions extending between said rings, said elongate portions being separated from each other by elongate slots and being slightly bent inwardly so as to together define a waist at a frictional engagement location therealong, at which inner facing surfaces of said generally elongate portions define, at rest, an imaginary circle having an inner diameter D4, less than said first inner diameter D1.

4. A retractable antenna according to claim 3 and wherein said inner elongate telescopic element has a back end and a forward end and includes a back cylindrical portion, near said back end, having an outer diameter D5, which is at least equal to said inner diameter D4 but less than said first inner diameter D1, so as to be frictionally engaged by said extended position retaining spring and a main cylindrical portion, forward of said back cylindrical portion, having an outer diameter D6, which is smaller than said inner diameter D4, so as not to be significantly frictionally engaged by said extended position retaining spring.

5. A retractable antenna according to claim 4 wherein in a generally non-extended orientation said main cylindrical portion lies inside of said extended position retaining spring, whereby due to the outer diameter D6 of said main cylindrical portion being less than the inner diameter D4 of said extended position retaining spring at said frictional engagement location, substantial frictional engagement of and consequent wear on said main cylindrical portion and said spring are avoided and wherein in fully extended orientation said back cylindrical portion lies inside of said spring, whereby due to the outer diameter D5 of said back cylindrical portion being at least equal to the inner diameter D4 of said extended position retaining spring at said frictional engagement location substantial frictional engagement of said back cylindrical portion and said extended position retaining spring is provided for desired retention of said antenna in an extended operative orientation.

6. A retractable antenna according to claim 1 and wherein said throughgoing bore also comprises a third elongate portion adjacent said opposite end having a third inner diameter D3, which is greater than said second inner diameter D2, said third elongate portion defining a recess for receiving a retaining ring for retaining said spring in position along said elongate axis.

7. A retractable antenna according to claim 6 and wherein said third elongate portion is necked inwardly adjacent said opposite end.

8. A retractable antenna comprising:

an outer elongate telescopic element extending along an elongate axis;

an inner elongate telescopic element which is slidable along said elongate axis with respect to said outer elongate telescopic element from a fully retracted position to a fully extended position; and an extended position retaining spring fixedly positioned with respect to said outer elongate telescopic element for frictional extended position retaining engagement with said inner elongate telescopic element when said inner elongate telescopic element is in said fully extended position but not when said inner elongate telescopic element is generally in a retracted position, said extended position retaining spring being a unitary element and having a generally cylindrical configuration defining an elongate gap extending along the length thereof, a pair of incomplete end rings and generally elongate portions extending between said rings, said elongate portions being separated from each other by elongate slots and being slightly bent inwardly so as to together define a waist at a frictional engagement location therealong, at which inner facing surfaces of said generally elongate portions define, at rest, an imaginary circle having an inner diameter D4.

9. A retractable antenna according to claim 8 and wherein said inner elongate telescopic element has a back end and a forward end and includes a back cylindrical portion, near said back end, having an outer diameter D5, which is at least equal to said inner diameter D4 so as to be frictionally engaged by said extended position retaining spring and a main cylindrical portion, forward of said back cylindrical portion, having an outer diameter D6, which is smaller than said inner diameter D4, so as not to be significantly frictionally engaged by said extended position retaining spring.

10. A retractable antenna according to claim 9 wherein in a generally non-extended orientation said main cylindrical portion lies inside of said extended position retaining spring, whereby due to the outer diameter D6 of said main cylindrical portion being less than the inner diameter D4 of said extended position retaining spring at said frictional engagement location, substantial frictional engagement of and consequent wear on said main cylindrical portion and said spring are avoided and wherein in fully extended orientation said back cylindrical portion lies inside of said spring, whereby due to the outer diameter D5 of said back cylindrical portion being at least equal to the inner diameter D4 of said extended position retaining spring at said frictional engagement location substantial frictional engagement of said back cylindrical portion and said extended position retaining spring is provided for desired retention of said antenna in an extended operative orientation.

* * * * *